US011401835B2

(12) United States Patent
Ongole et al.

(10) Patent No.: US 11,401,835 B2
(45) Date of Patent: Aug. 2, 2022

(54) TURBINE CENTER FRAME

(71) Applicant: General Electric Company, Schenectady, NY (US)

(72) Inventors: Chaitanya Venkata Rama Krishna Ongole, Bangalore (IN); John Joseph, Bangalore (IN); Ganesh Seshadri, Bangalore (IN); Ravikanth Avancha, Bangalore (IN)

(73) Assignee: General Electric Company, Schenectady, NY (US)

( * ) Notice: Subject to any disclaimer, the term of this patent is extended or adjusted under 35 U.S.C. 154(b) by 1021 days.

(21) Appl. No.: 15/620,264

(22) Filed: Jun. 12, 2017

(65) Prior Publication Data

US 2018/0355763 A1 Dec. 13, 2018

(51) Int. Cl.

| | |
|---|---|
| ***F01D 25/28*** | (2006.01) |
| ***F01D 5/14*** | (2006.01) |
| ***F01D 9/04*** | (2006.01) |
| ***F01D 25/16*** | (2006.01) |

(52) U.S. Cl.

CPC ..... *F01D 25/28* (2013.01); *F01D 5/143* (2013.01); *F01D 9/041* (2013.01); *F01D 25/162* (2013.01)

(58) Field of Classification Search

CPC ..... F01D 5/143; F01D 9/041; F01D 25/14; F01D 25/162; F01D 25/28

See application file for complete search history.

(56) References Cited

U.S. PATENT DOCUMENTS

| | | | | |
|---|---|---|---|---|
| 3,978,664 | A * | 9/1976 | Parker | F04D 29/542 60/726 |
| 4,548,546 | A * | 10/1985 | Lardellier | F01D 21/003 33/543 |
| 5,520,512 | A * | 5/1996 | Walker | F01D 1/04 29/888.021 |
| 6,358,001 | B1 | 3/2002 | Bosel et al. | |
| 7,895,840 | B2 | 3/2011 | Haller | |
| 2008/0134688 | A1 | 6/2008 | Somanath et al. | |
| 2008/0276621 | A1 | 11/2008 | Somanath et al. | |
| 2010/0021286 | A1 | 1/2010 | Somanath et al. | |
| 2010/0303608 | A1 | 12/2010 | Kataoka et al. | |
| 2016/0348591 | A1* | 12/2016 | Suciu | F01D 9/042 |

* cited by examiner

*Primary Examiner* — Scott J Walthour

(74) *Attorney, Agent, or Firm* — McGarry Bair PC

(57) ABSTRACT

An apparatus and method for diffusing an airflow in a turbine engine can include a turbine center frame positioned between a high pressure turbine and a low pressure turbine of a turbine section of the engine. The turbine center frame can include two or more diffusion sections for diffusing the airflow. A stabilization section can be provided between the two or more diffusion sections to stabilize the airflow.

29 Claims, 6 Drawing Sheets

TURBINE CENTER FRAME

BACKGROUND OF THE INVENTION

Turbine engines, and particularly gas or combustion turbine engines, are rotary engines that extract energy from a flow of combusted gases passing through the engine onto a multitude of rotating turbine blades.

Gas turbine engines can include a compressor that compresses an airflow and a turbine that drives the compressor utilizing the compressed airflow. The turbine can be separated into a high pressure turbine and a low pressure turbine, with a turbine center frame positioned between the two serving as a duct for fluid flowing from the high pressure turbine to the low pressure turbine. The turbine center frame provides for diffusing the fluid between the high pressure turbine and the low pressure turbine. Such diffusion is limited by flow separation of the fluid passing through the turbine center frame, where flow separation can negatively impact engine efficiency.

BRIEF DESCRIPTION OF THE INVENTION

In one aspect, the disclosure relates to a turbine engine including an engine core defining an engine centerline and including a compressor section, a combustion section, and a turbine section including a high-pressure turbine and a low-pressure turbine in axial flow arrangement defining a mainstream flow path. A turbine center frame extends from the high pressure turbine to the low pressure turbine and includes at least two diffusion sections, upstream and downstream of one another relative to a flow direction of the mainstream flow path. The downstream section is spaced further from the engine centerline than the upstream diffusion section.

In another aspect, the disclosure relates to a turbine center frame for a turbine engine defining an engine centerline and a flow direction extending from a high pressure turbine to a low pressure turbine and includes at least two diffusion sections, upstream and downstream of one another relative to the flow direction. At least one intervening section is provided between the at least two diffusion sections.

In yet another aspect, the disclosure relates to a method of diffusing airflow through a turbine center frame provided in a turbine engine including: directing a flow of air through an upstream diffusion section; directing the flow of air through an intervening section; and direction the flow of air through a downstream diffusion section.

DETAILED DESCRIPTION OF THE INVENTION

Figure 1:
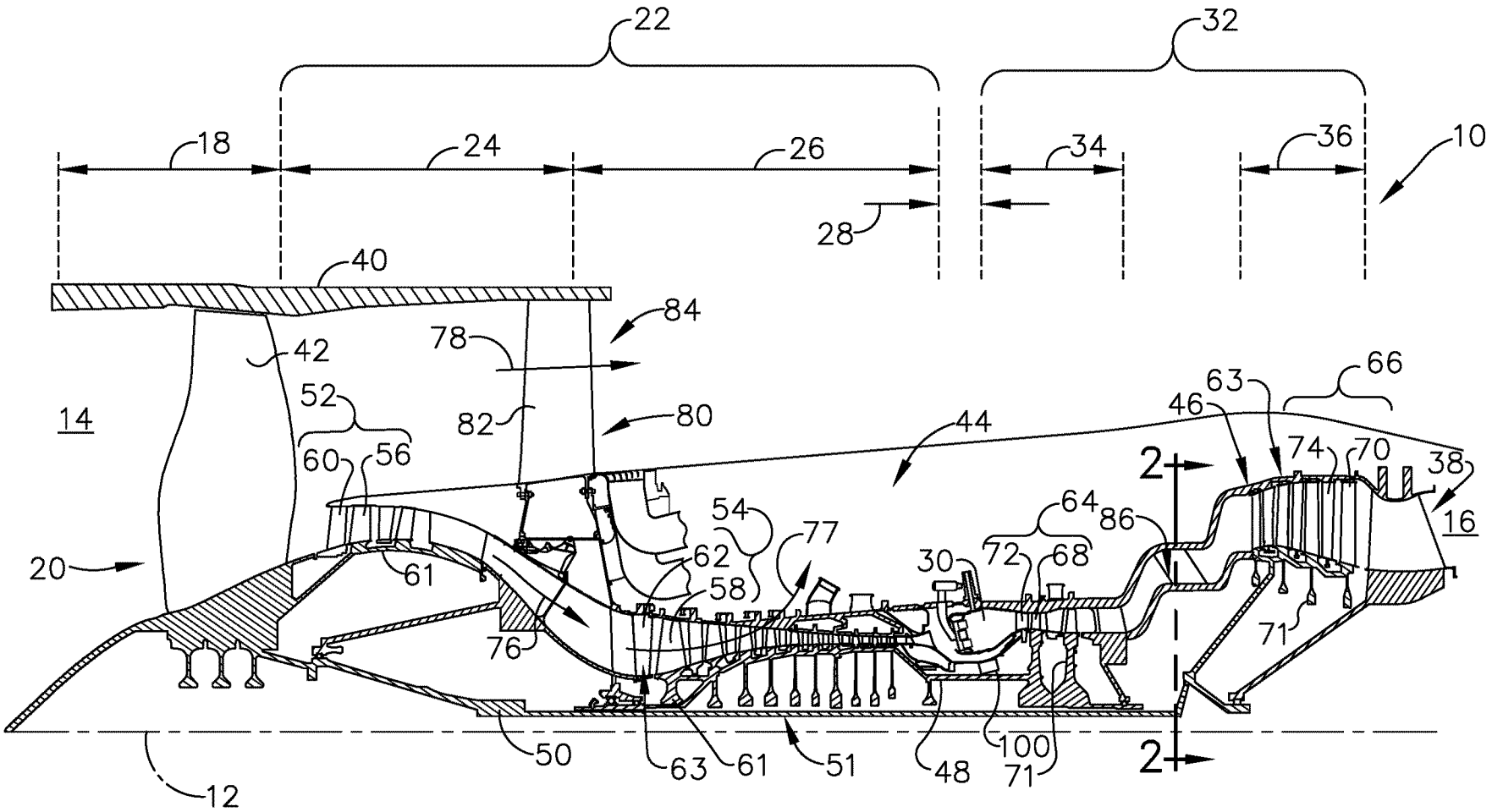
FIG. 1 is a schematic cross-sectional diagram of a gas turbine engine for an aircraft including a turbine center frame provided between a high pressure turbine and a low pressure turbine.

Aspects of the disclosure described herein are directed to a turbine center frame having staged diffusion sections. For purposes of illustration, the present disclosure will be described with respect to the turbine for an aircraft gas turbine engine. It will be understood, however, that aspects of the disclosure described herein are not so limited and may have general applicability within an engine or any diffusion section, including compressors, as well as in non-aircraft applications, such as other mobile applications and non-mobile industrial, commercial, and residential applications.

As used herein, the term "forward" or "upstream" refers to moving in a direction toward the engine inlet, or a component being relatively closer to the engine inlet as compared to another component. The term "aft" or "downstream" used in conjunction with "forward" or "upstream" refers to a direction toward the rear or outlet of the engine or being relatively closer to the engine outlet as compared to another component. Additionally, as used herein, the terms "radial" or "radially" refer to a dimension extending between a center longitudinal axis of the engine and an outer engine circumference. As used herein, a "set" can include any number of an element, including only one.

All directional references (e.g., radial, axial, proximal, distal, upper, lower, upward, downward, left, right, lateral, front, back, top, bottom, above, below, vertical, horizontal, clockwise, counterclockwise, upstream, downstream, forward, aft, etc.) are only used for identification purposes to aid the reader's understanding of the present disclosure, and do not create limitations, particularly as to the position, orientation, or use of aspects of the disclosure described herein. Connection references (e.g., attached, coupled, connected, and joined) are to be construed broadly and can include intermediate members between a collection of elements and relative movement between elements unless otherwise indicated. As such, connection references do not necessarily infer that two elements are directly connected and in fixed relation to one another. The exemplary drawings are for purposes of illustration only and the dimensions, positions, order and relative sizes reflected in the drawings attached hereto can vary.

FIG. 1 is a schematic cross-sectional diagram of a gas turbine engine 10 for an aircraft. The engine 10 has a generally longitudinally extending axis or centerline 12 extending forward 14 to aft 16. The engine 10 includes, in downstream serial flow relationship, a fan section 18 including a fan 20, a compressor section 22 including a booster or low pressure (LP) compressor 24 and a high pressure (HP) compressor 26, a combustion section 28 including a combustor 30, a turbine section 32 including a HP turbine 34, and a LP turbine 36, and an exhaust section 38.

The fan section 18 includes a fan casing 40 surrounding the fan 20. The fan 20 includes a plurality of fan blades 42 disposed radially about the centerline 12. The HP compressor 26, the combustor 30, and the HP turbine 34 form a core 44 of the engine 10, which generates combustion gases. The core 44 is surrounded by core casing 46, which can be coupled with the fan casing 40.

A HP shaft or spool 48 disposed coaxially about the centerline 12 of the engine 10 drivingly connects the HP turbine 34 to the HP compressor 26. A LP shaft or spool 50, which is disposed coaxially about the centerline 12 of the engine 10 within the larger diameter annular HP spool 48, drivingly connects the LP turbine 36 to the LP compressor 24 and fan 20. The spools 48, 50 are rotatable about the engine centerline and couple to a plurality of rotatable elements, which can collectively define a rotor 51.

The LP compressor 24 and the HP compressor 26 respectively include a plurality of compressor stages 52, 54, in which a set of compressor blades 56, 58 rotate relative to a corresponding set of static compressor vanes 60, 62 (also called a nozzle) to compress or pressurize the stream of fluid passing through the stage. In a single compressor stage 52, 54, multiple compressor blades 56, 58 can be provided in a ring and can extend radially outwardly relative to the centerline 12, from a blade platform to a blade tip, while the corresponding static compressor vanes 60, 62 are positioned upstream of and adjacent to the rotating blades 56, 58. It is noted that the number of blades, vanes, and compressor stages shown in FIG. 1 were selected for illustrative purposes only, and that other numbers are possible.

The blades 56, 58 for a stage of the compressor can be mounted to a disk 61, which is mounted to the corresponding one of the HP and LP spools 48, 50, with each stage having its own disk 61. The vanes 60, 62 for a stage of the compressor can be mounted to the core casing 46 in a circumferential arrangement.

The HP turbine 34 and the LP turbine 36 respectively include a plurality of turbine stages 64, 66, in which a set of turbine blades 68, 70 are rotated relative to a corresponding set of static turbine vanes 72, 74 (also called a nozzle) to extract energy from the stream of fluid passing through the stage. In a single turbine stage 64, 66, multiple turbine blades 68, 70 can be provided in a ring and can extend radially outwardly relative to the centerline 12, from a blade platform to a blade tip, while the corresponding static turbine vanes 72, 74 are positioned upstream of and adjacent to the rotating blades 68, 70. It is noted that the number of blades, vanes, and turbine stages shown in FIG. 1 were selected for illustrative purposes only, and that other numbers are possible.

The blades 68, 70 for a stage of the turbine can be mounted to a disk 71, which is mounted to the corresponding one of the HP and LP spools 48, 50, with each stage having a dedicated disk 71. The vanes 72, 74 for a stage of the compressor can be mounted to the core casing 46 in a circumferential arrangement.

Complementary to the rotor portion, the stationary portions of the engine 10, such as the static vanes 60, 62, 72, 74 among the compressor and turbine section 22, 32 are also referred to individually or collectively as a stator 63. As such, the stator 63 can refer to the combination of non-rotating elements throughout the engine 10.

In operation, the airflow exiting the fan section 18 is split such that a portion of the airflow is channeled into the LP compressor 24, which then supplies pressurized air 76 to the HP compressor 26, which further pressurizes the air. The pressurized air 76 from the HP compressor 26 is mixed with fuel in the combustor 30 and ignited, thereby generating combustion gases. Some work is extracted from these gases by the HP turbine 34, which drives the HP compressor 26. The combustion gases are discharged into the LP turbine 36, which extracts additional work to drive the LP compressor 24, and the exhaust gas is ultimately discharged from the engine 10 via the exhaust section 38. The driving of the LP turbine 36 drives the LP spool 50 to rotate the fan 20 and the LP compressor 24.

A portion of the pressurized airflow 76 can be drawn from the compressor section 22 as bleed air 77. The bleed air 77 can be drawn from the pressurized airflow 76 and provided to engine components requiring cooling. The temperature of pressurized airflow 76 entering the combustor 30 is significantly increased. As such, cooling provided by the bleed air 77 is necessary for operating of such engine components in the heightened temperature environments.

A remaining portion of the airflow 78 bypasses the LP compressor 24 and engine core 44 and exits the engine assembly 10 through a stationary vane row, and more particularly an outlet guide vane assembly 80, comprising a plurality of airfoil guide vanes 82, at the fan exhaust side 84. More specifically, a circumferential row of radially extending airfoil guide vanes 82 are utilized adjacent the fan section 18 to exert some directional control of the airflow 78.

Some of the air supplied by the fan 20 can bypass the engine core 44 and be used for cooling of portions, especially hot portions, of the engine 10, and/or used to cool or power other aspects of the aircraft. In the context of a turbine engine, the hot portions of the engine are normally downstream of the combustor 30, especially the turbine section 32, with the HP turbine 34 being the hottest portion as it is directly downstream of the combustion section 28. Other sources of cooling fluid can be, but are not limited to, fluid discharged from the LP compressor 24 or the HP compressor 26.

A turbine center frame 86 can be provided between the HP turbine 34 and the LP turbine 36. The turbine center frame 86 can be a transition duct provided between the HP turbine 34 and the LP turbine 36. As such, the turbine center frame can begin at the aft end of the HP turbine 34 and terminate at the forward end of the LP turbine 36. The turbine center frame 86 can provide for fluidly coupling the HP turbine 34 to the LP turbine 36 and diffusing the flow of fluid exhausting from the HP turbine 34. In one example, the turbine center frame 86 can turn the flow in a tangential direction relative to the engine centerline 12. The turbine center frame 86 can further act as a structural member for supporting pass tubing, secondary flow systems, or lubrications systems.

Figure 2:
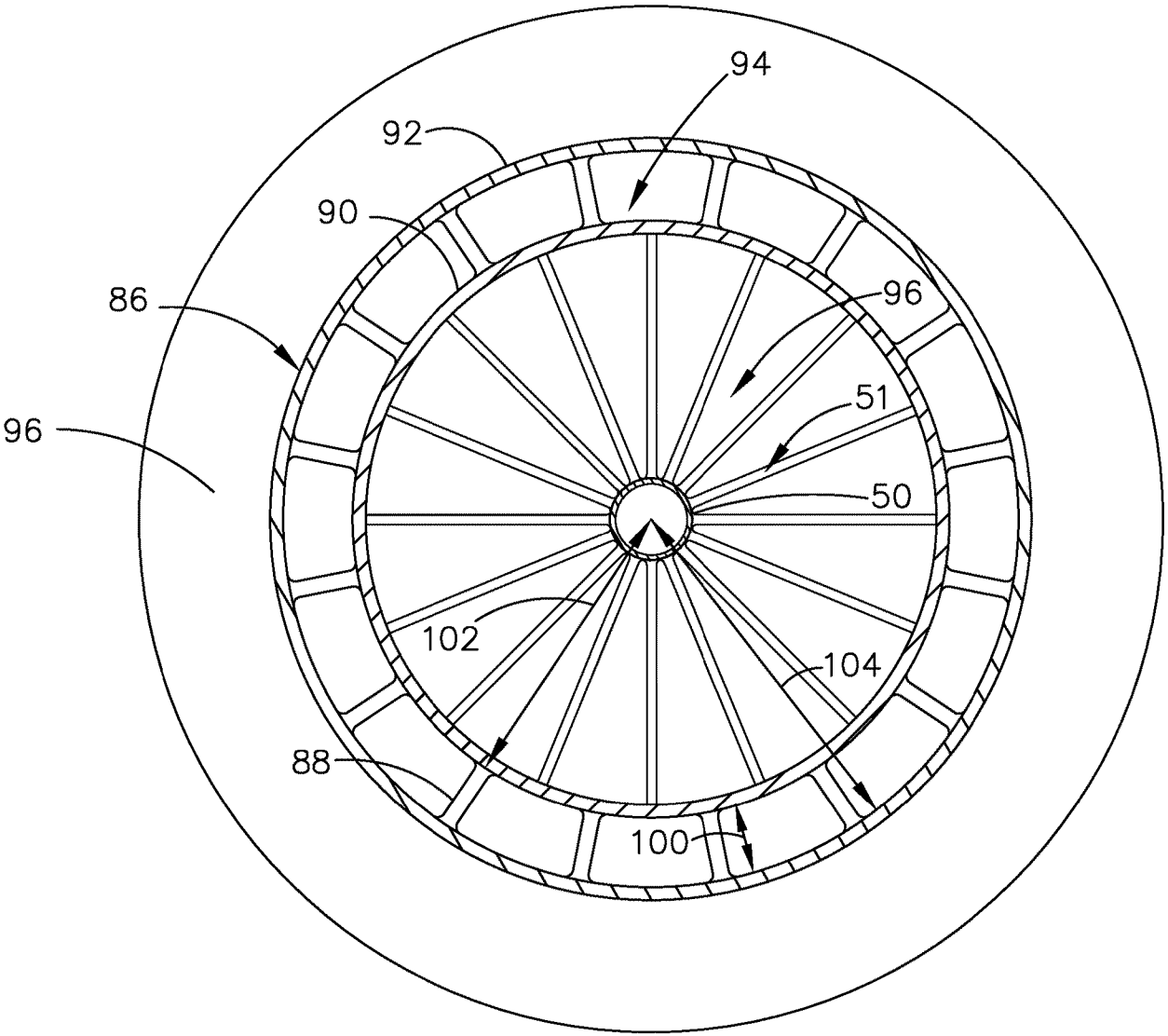
FIG. 2 is a cross-sectional view of the gas turbine engine of FIG. 1 taken along section 2-2 illustrating an annular mainstream flow path.

Referring now to FIG. 2, the turbine center frame 86 includes an annular, radially inner wall 90 and an annular, radially outer wall 92 spaced radially exterior of the radially inner wall 90. In one non-limiting example, the core casing 46 of FIG. 1, for example can form the radially outer wall 92, and the stator 63, for example, can form the radially inner wall 90. The radially inner and outer walls 90, 92 may be axially and circumferentially continuous, or alternatively can be made of multiple axial or circumferential segments. A set of struts 88 are arranged circumferentially around the turbine center frame 86 extending between the radially inner and outer walls 90, 92. While sixteen struts 88 are illustrated, it should be appreciated that any number of struts 88 can be arranged circumferentially about the turbine center frame 86, and can be organized into multiple rows or sets of struts 88. Furthermore, the struts 88 can have an airfoil shape or other suitable shape or geometry impacting a flow passing along the struts 88. Such as shape could turn a flow of fluid passing along the struts 88. In one alternative example, small blades could be positioned between adjacent struts 88 to affect an airflow passing through the turbine center frame.

Furthermore, the struts 88 need not be aligned radially relative to the engine centerline, but can be angled or leaned tangentially, or be positioned in any other form or orientation resultant of a desired aerodynamic design or analysis. Further still, the struts 88 can includes a bow or sweep, or any suitable curvature to the struts 88.

An annular, mainstream flow path 94 is defined between the radially inner and outer walls 90, 92. As illustrated, the mainstream flow path 94 can define a flow direction extending into the page, representative of the axial flow passing through the engine 10. A set of rotor elements 96, as a portion of the rotor 51, can extend from the LP spool 50 to other rotor 51 components of the engine 10, such as the LP turbine blades 70 of FIG. 1. A frame casing 98 can house the turbine center frame. The radially outer wall 92 can form the core casing 98, for example.

A cross-sectional distance 100 can be measured between the radially inner wall 90 and the radially outer wall 92, extending in the radial direction relative to the engine centerline 12. Similarly, a cross-sectional area can be defined for the mainstream flow path 94, with the cross-sectional area measured in the radial direction as the annular area between the radially inner and outer walls 90, 92. The cross-sectional area of the mainstream flow path can be a function of a radius 102 for the radially inner wall 90 and a radius 104 for the radially outer wall. The radially inner wall 90 defines a radially inner limit for the mainstream flow path 94 and the radially outer wall 92 defines a radially outer limit for the mainstream flow path 94, which can be represented by the radiuses 102, 104. For example, the cross-sectional area can be determined as area of the radially inner wall 90 subtracted from the area of the radially outer wall 92. Therefore, as the radius 104 of the radially outer walls 92 increases, the cross-sectional area increased and as the radius 102 of the radially inner wall 90 increases, the cross-sectional area decreases. In the case where both the radially inner and outer walls 90, 92 increases simultaneously, then the rate of increase for the radially inner and outer walls 90, 92 can be determinative of the change in the cross-sectional area. Such a rate of increase of radius for the radially inner and outer walls 90, 92 can be measured over a distance in an axial direction, such as into or out of the page as shown in FIG. 2.

Figure 3:
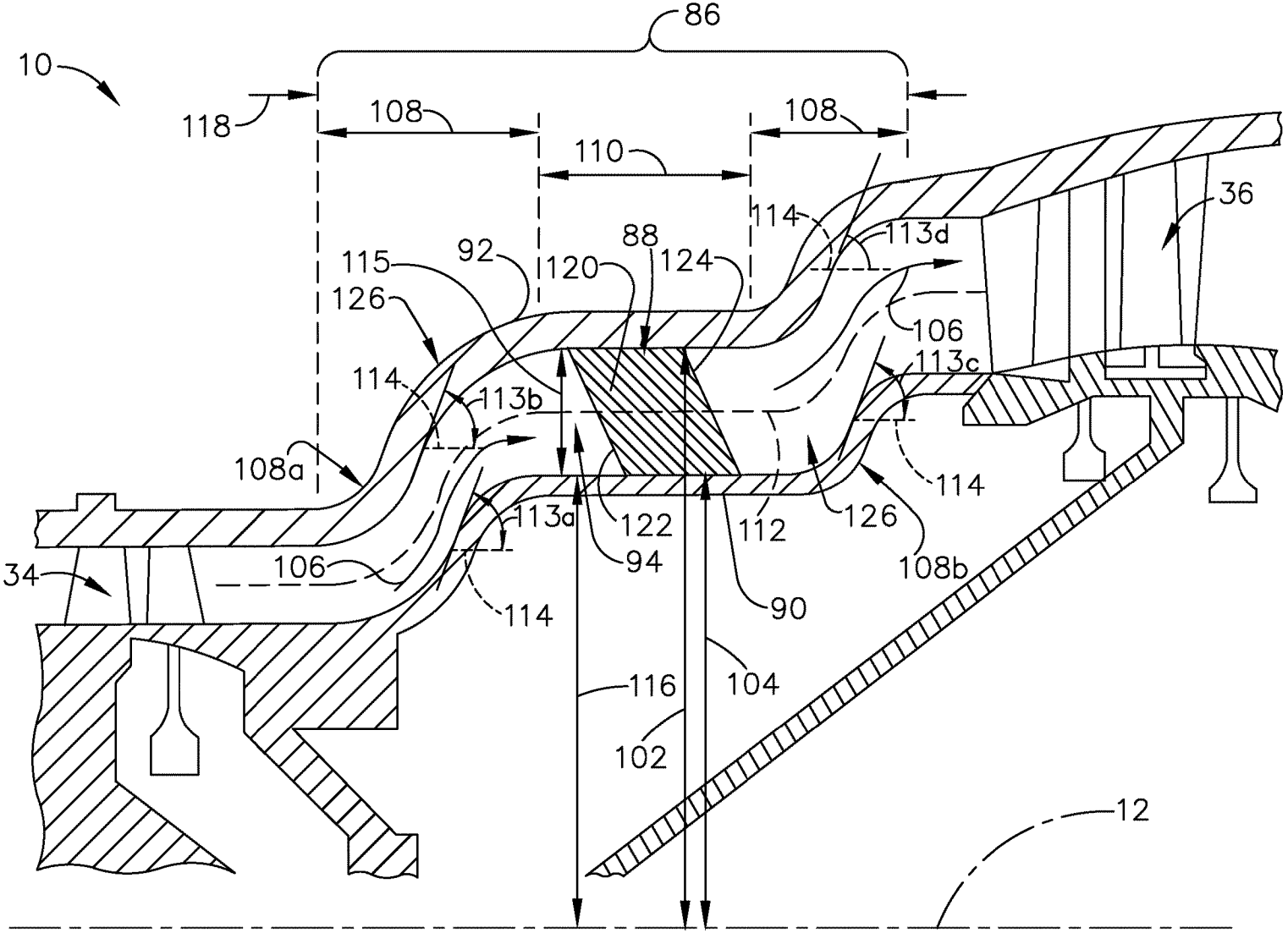
FIG. 3 is an enlarged view of the turbine center frame of FIG. 1 including an intervening section provided between two diffusion sections with a strut provided in the intervening section.

Referring now to FIG. 3, the turbine center frame 86 extends from the HP turbine 34 to the LP turbine 36. A flow direction of a flow of fluid is represented by arrow 106 can be defined passing from the HP turbine 34 toward the LP turbine 36 through the turbine center frame 86.

Two diffusion sections 108 are included in the turbine center frame 86, including an upstream diffusion section 108*a* and a downstream diffusion section 108*b* relative to the flow direction of the flow of fluid 106. The diffusion sections 108 include an increasing radius 102, 104 for the radially inner and outer walls 90, 92 relative to the engine centerline 12. The downstream diffusion section 108*b* can have greater radiuses 102, 104 than the upstream diffusion section 108*a*. It should be understood that the radially inner or outer walls 90, 92 for the diffusion sections 108 need not both require an increasing radius 102, 104, but the either of the radially inner or outer walls 90, 92 can have an increasing radius 102, 104. In one alternative example, the inner or outer walls 90, 92 can have a decreasing radius 102, 104. In another example, one of the inner wall 90 or the outer wall 92 can be increasing while the other is decreasing. In yet another example, the inner and outer walls 90, 92 of the upstream diffusion section 108*a* can be increasing while the downstream diffusion section 108*b* can be decreasing.

As the mainstream flow path 94 is annular, the increasing radius 102, 104 for the diffusion sections 108 can define an increasing cross-sectional area for the mainstream flow path 94 in the aft or axial direction along the diffusion section 108. The increasing cross-sectional area as used herein means that the mainstream flow path 94 within the diffusion sections 108 has a greater cross-sectional area defined between radially inner and outer walls 90, 92 annularly about the engine centerline 12, as the turbine center frame 86 extends aft within the diffusion sections 108 in the flow direction of the flow of fluid 106. The increasing cross-sectional area provides for diffusion of the flow of fluid 106 passing through turbine center frame 86.

The increasing radius 102, 104 in the axial direction defining the increasing cross-sectional area through the diffusion sections 108 can be defined by a positive slope for the diffusion sections 108. The positive slope can be defined as the rate of increasing radius 102, 104 for the radially inner and radially outer walls 90, 92 in the axial direction. The slope for the diffusion sections 108 need not be constant, and can define a maximum slope as the greatest slope within the diffusion sections 108. The slope can be calculated as the rate of radius increase over axial distance. The slope, for example, can be between 0.33 and 0.66, but can be as much as 0.77 in one non-limiting example. The increasing cross-sectional area can alternatively be defined based upon a maximum angle 113*a-d* of the inner and outer walls 90, 92. Such an angle 113*a-d* can be defined relative to an axis 114 parallel to the engine centerline 12 transposed at the local radially inner or outer wall 90, 92. The angle 113 can be between 30 and 60 degrees, and can be as much as 70 degrees at the point of greatest rate of increasing radius 102, 104 through the diffusion section 108. Different angles can be defined for each diffusion section 108, at the radially inner and outer walls 90, 92, as a first angle 113*a* at the radially inner wall 90 of the first diffusion section 108*a*, a second angle 113*b* at the radially outer wall 92 of the first diffusion section 108*a*, a third angle 113*c* at the radially inner wall 90 of the second diffusion section 108*b*, and a fourth angle 113*d* at the radially outer wall 92 of the second diffusion section 108*b*. In one example, the angles 113*a-d* can all be the same or different from one another. Alternatively in another example, the first and second angles 113*a*, 113*b* of the first diffusion section 108*a* can be the same as one another while the third and fourth angles 113*c*, 113*d* can be the same as one another, but different from the first and second angles 113*a*, 113*b*. In yet another example, the first and third angles 113*a*, 113*c* along the radially interior wall 90 can be the same, while the second and fourth angles 113*b*, 113*d* along the radially outer wall 92 can be the same, but different from the first and third angles 113*a*, 113*c*.

In another example, a mean flow path line 112 defined equidistant from the radially inner and radially outer walls 90, 92 can define the slope or the angle for the diffusion sections 108, having an increasing radius 102, 104 in the flow direction of the flow of fluid 106 relative to the engine centerline 12. The mean flow path line 112 can be beneficial for defining the diffusion sections 108 when the radially inner and radially outer walls 90, 92 include differing slopes or angles, or have differing rates of increasing radius 102, 104.

The distance 115 can be constant in the radial direction between the radially inner wall 90 and the radially outer wall 92 along the turbine center frame 86. The increasing radius 102, 104 for the diffusion sections 108 with the annular geometry of the mainstream flow path 94 provides for diffusing of the flow of fluid in the flow direction of the flow of fluid 106 through the mainstream flow path 94. The increasing radius 102, 104 of the radially inner or outer walls 90, 92 defining the annular mainstream flow path 94 provides for defining an increasing cross-sectional area for the mainstream flow path 94 in the flow direction of the flow of fluid 106 within the diffusion sections 108. Alternatively, it is contemplated that the distance can be increasing or decreasing along the flow path through the turbine center frame 86.

An intervening section 110 can be provided between the diffusion sections 108. The intervening section 110 can include a constant radius 102, 104 for the radially inner and radially outer walls 90, 92. It is also contemplated that the intervening section 110 can be slightly sloped with an increasing radius 102, 104 lesser than that of the angles 113*a-d* of the diffusion sections 108*a*, 108*b*. Such a slope can be less than the slopes for the upstream or downstream diffusion sections 108*a*, 108*b*, for example. A transition 126 from the upstream diffusion section 108*a* to the intervening section 110, or from the intervening section 110 to the downstream diffusion section 108*b* can include a slope or an angle that is less than that of the diffusion sections 108, but greater than that of the intervening section 110, providing a smooth transition between the areas to reduce flow separation in the transition areas.

The struts 88 can be provided in the turbine center frame 86. The struts 88 can be airfoil-shaped, for example, having a plurality of struts 88 arranged circumferentially about the turbine center frame 86, permitting the flow of fluid 106 to pass about the struts 8. The strut 88 can influence the flow of fluid 106 passing through the turbine center frame, such as turning the flow of fluid 106 to increase a helical or axial directionality, in non-limiting examples. The struts 88 can be positioned within the intervening section 110, and can provide for supporting the turbine center frame 86, such as by mounting to the engine core casing 46 of FIG. 1. A leading edge 122 can be positioned adjacent the upstream diffusion section 108 and a trailing edge 124 can be positioned adjacent the downstream diffusion section 108.

The diffusion sections 108 provide for greater slopes or local angles for the turbine center frame 86. Typical turbine center frames are limited to certain slopes or angles in order to prevent flow separation of the flow of fluid 106 reducing engine efficiency, or are limited by flow separation in the turbine center frame 86, while diffusing an airflow through the turbine center frame 86. The diffusion sections 108 provide for diffusing the flow of fluid 106 at a greater rate, while the intervening section 110 provides for mitigating flow separation generated by the diffusion sections 108 and remaining within required stall margins.

The diffusion sections 108 can include aggressive casing slopes while diffusing the airflow in an efficient manner. Similarly, the aggressive casing slopes provide for an increased rate of diffusion through the turbine center frame 86. While the diffusion sections 108 can increase the total axial length of the turbine center frame 86 when combined with the intervening sections 110, the increased rate of diffusion through the turbine center frame 86 can reduce the required number of low-pressure turbine stages, minimizing overall cost and complexity of the engine 10.

Figure 4:
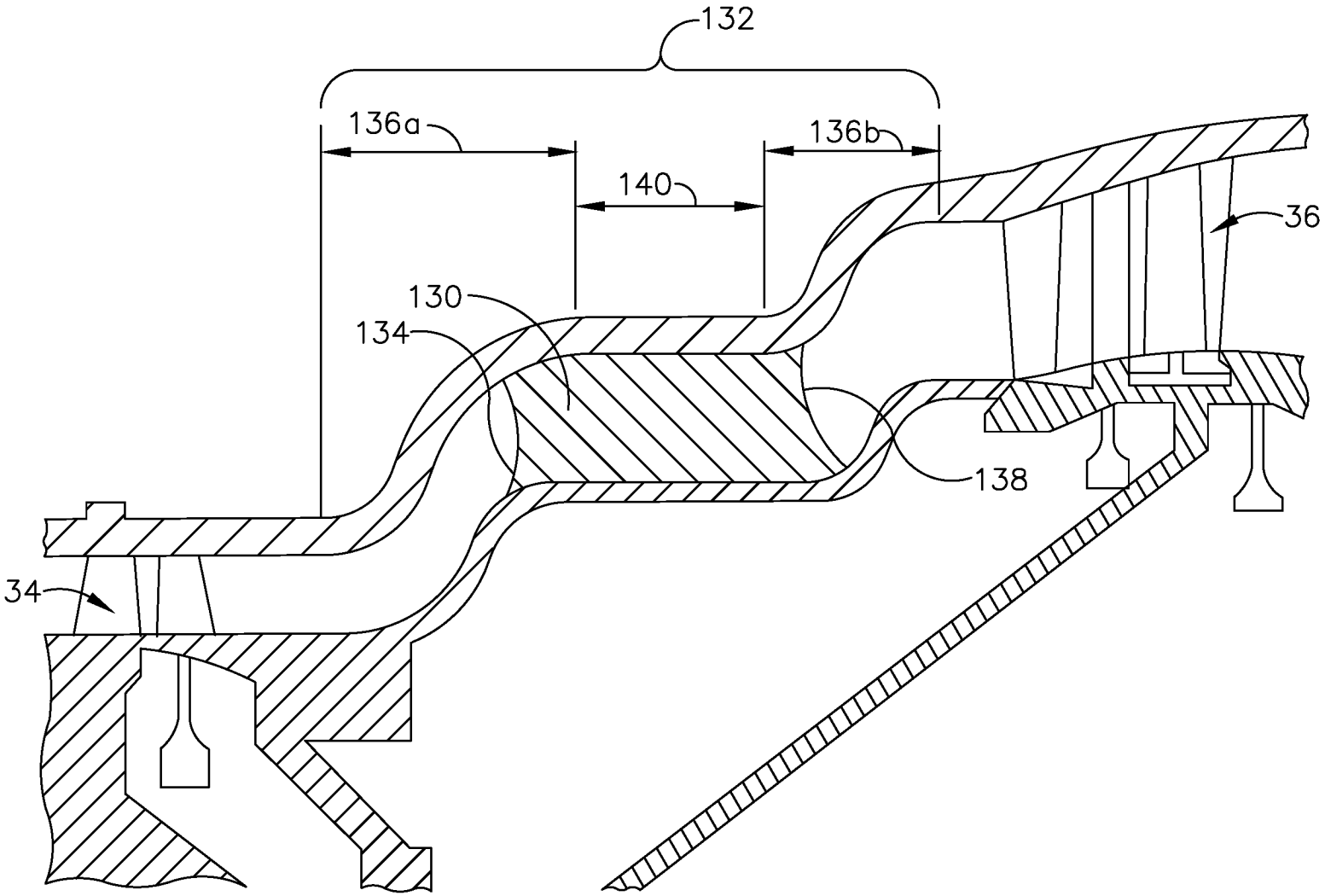
FIG. 4 is a view of an alternative turbine center frame with two diffusion sections and a strut including a leading edge in an upstream diffusion section and a trailing edge in a downstream diffusion section.

The turbine center frame 86 including the diffusion sections 108 and the intervening sections 110 provide for flexibility of placement of the strut 88. Referring to FIG. 4, an alternative strut 130 is provided in a turbine center frame 132, with a leading edge 134 provided in the upstream diffusion section 136*a* and a trailing edge 138 provided in a downstream diffusion section 136*b*. Positioning the strut 88 within the leading edge 134 and the trailing edge 138 in the diffusion sections 108 provides for a greater curvature and a greater slope within the diffusion sections 108 along the radially inner and outer walls 90, 92. Such increased curvature or slope provides the potential to further increased aerodynamic performance through the turbine center frame 86. Furthermore, the overall axial length of the struts 88 is increased, which provides for ease of installation for attached structural members.

It should be appreciated that the diffusion sections 136 and intervening sections 140 provide for flexible placement of the strut 130 in the turbine center frame 132.

Figure 5:
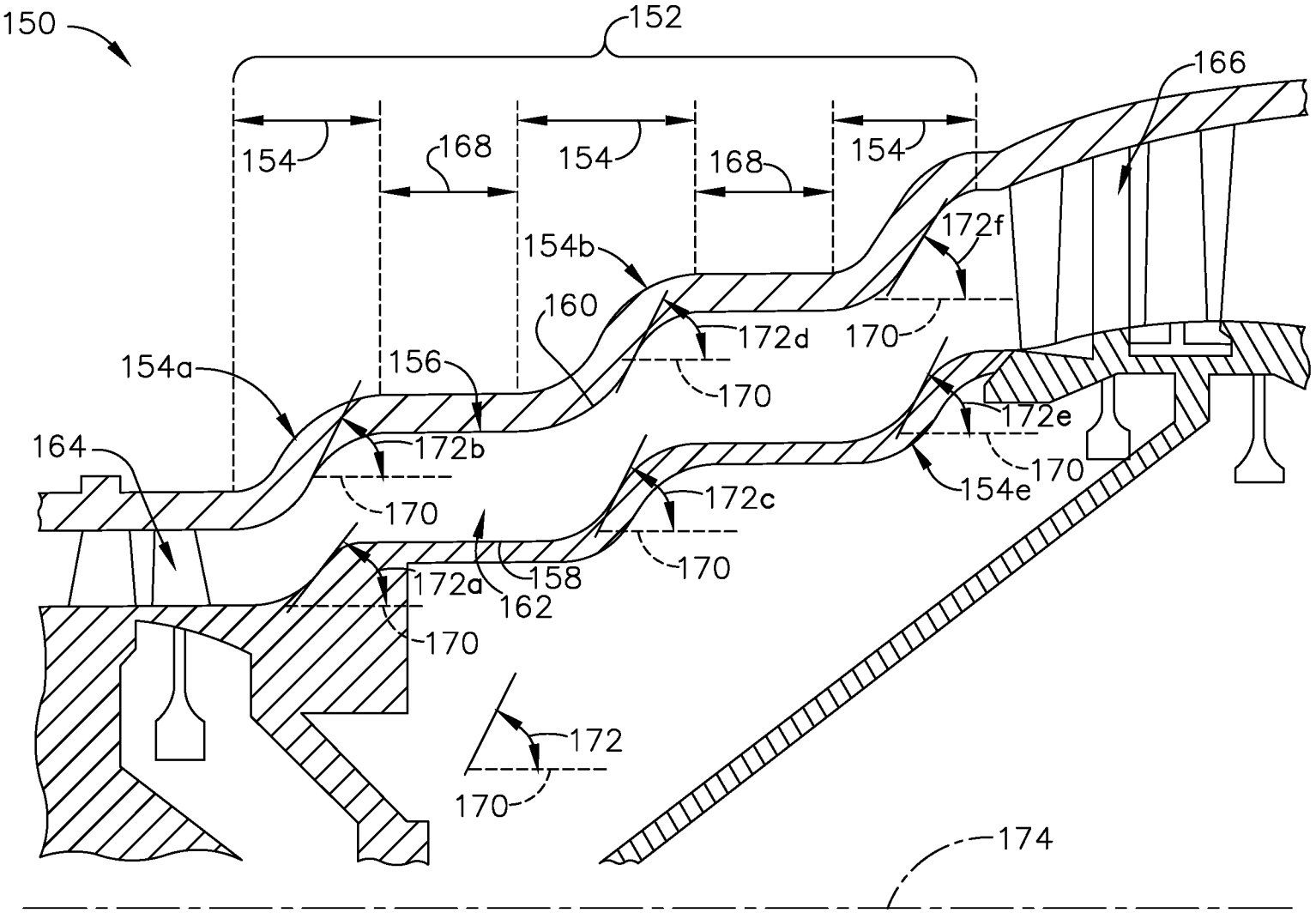
FIG. 5 is a view of another alternative turbine center frame having three diffusion sections.

Referring now to FIG. 5, another engine 150 is illustrated including a turbine center frame 152 with three diffusion sections 154, e.g., a first diffusion section 154*a*, a second diffusion section 154*b*, and a third diffusion section 154*c* in axial arrangement. An annular, radially inner wall 158 and an annular, radially outer wall 160 and defines a mainstream flow path 162 extending through the engine 150 from a high-pressure turbine 164 to a low-pressure turbine 166. The diffusion sections 154 can include increasing cross-sectional areas, defined by an increasing slope for the radially inner and radially outer walls 158, 160, having a maximum slope that is between 0.22 and 0.66 relative to a horizontal engine centerline 174, and can be as much as 0.77 in one non-limiting example. Alternatively, the increasing cross-sectional areas for the diffusion sections 154 can be defined as having an angle 172 that is between 20 and 60 degrees, and can be as much as 70 degrees, relative to an axis 170 parallel to the engine centerline 174 and transposed over the local inner or outer walls 158, 160 of the diffusion sections 154. The angles 172 can be separated into a first angle 172*a* as the angle of the radially inner wall 158 of the first diffusion section 154*a*, a second angle 172*b* as the angle of the radially outer wall 160 of the first diffusion section 154*a*, a third angle 172*c* as the angle of the radially inner wall 158 of the second diffusion section 154*b*, a fourth angle 172*d* as the angle of the radially outer wall 160 of the second diffusion section 154*b*, a fifth angle 172*e* as the angle of the radially inner wall 158 of third diffusion section 154*c*, and a sixth angle 172*f* as the angle of the radially outer wall 160 of the third diffusion section 154*c*. The angles 172*a-f* can be measure at the position of maximum slope along the radially inner and outer walls 158, 160, relative to the engine centerline 174. It should be understood the angles 172*a-f* can be all the same angle or can all be different. Alternatively, the angles of the same diffusion section 154 can have the same angle, such as the first and second angles 172*a-b* of the first diffusion section 154*a*.

Two intervening sections 168 are provided between the diffusion sections 154. The intervening sections 168 can have a slope of zero or have a portion of the radially inner and outer walls 158, 160 that is parallel to the engine centerline 168. Alternatively, the intervening sections 168 can have a slight slope that is less than 0.166, or define an angle that is less than fifteen degrees.

Figure 6:
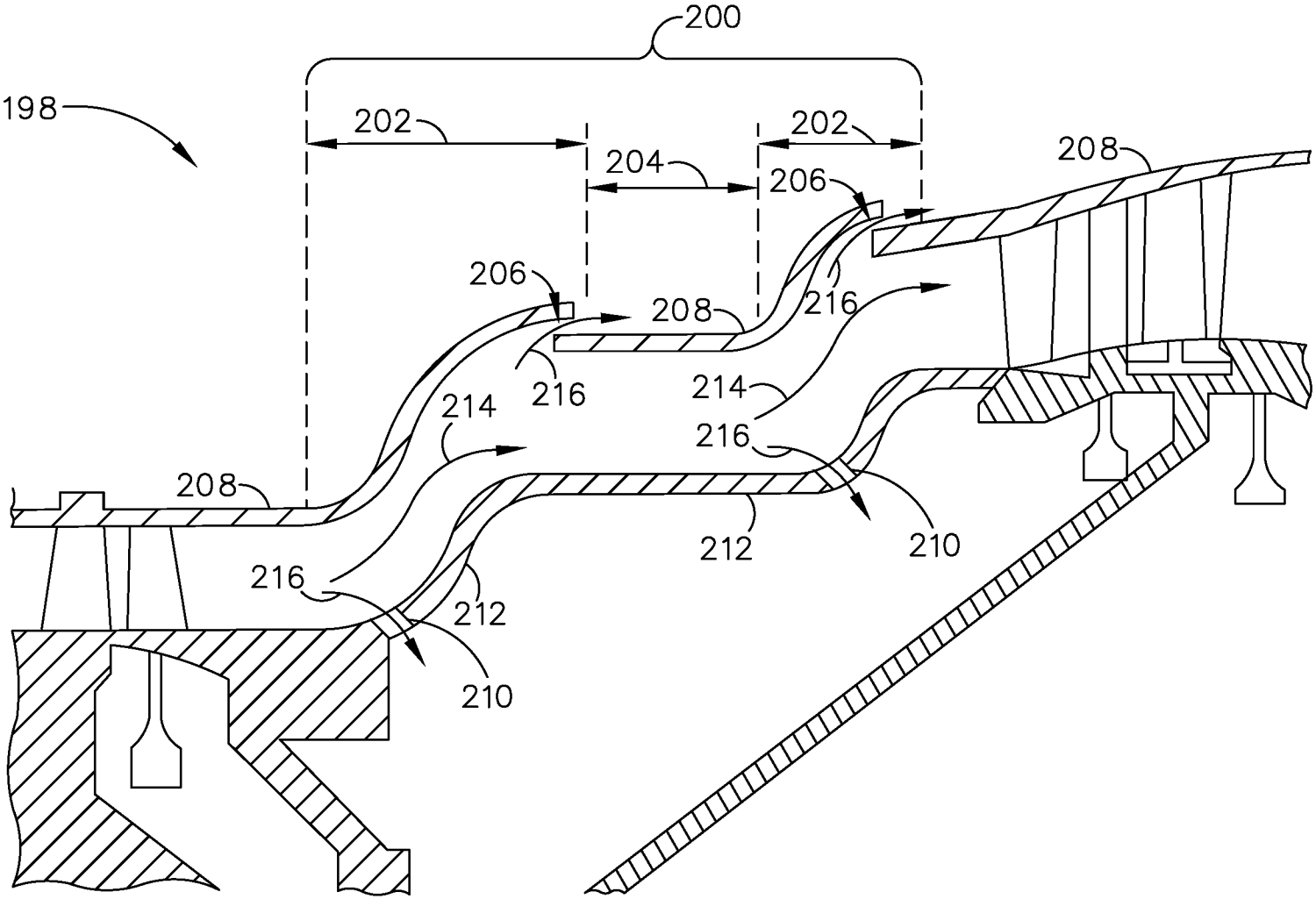
FIG. 6 is a view of yet another alternative turbine center frame having exhaust ports for drawings a flow of fluid from the turbine center frame.

Referring now to FIG. 6, an alternative engine 198 is shown with a turbine center frame 200 having two diffusion sections 202 and an intervening section 204 provided between the diffusion sections 202. The turbine center frame 200 as shown is exemplary, and the aspects as described herein are applicable to any of the other aspects, such that different elements among differing descriptions can be combined with one another and should not be limited to the depictions in the figures.

An exterior port 206 can be formed in a radially outer wall 208. The exterior port 206 can be positioned at the aft end of each of the diffusion sections 202. The exterior port 206 as shown can be formed as a gap in radially outer wall 208, or can be formed as an aperture in the exterior wall. Such apertures or gaps forming the exterior port 206 can be arranged circumferentially about the engine 198, with spacing interconnecting the portions of the turbine center frame 200.

An interior port 210 can be formed in a radially inner wall 212. The interior ports 210 can be formed at a forward portion of the diffusion sections 202. The interior ports 210 can be formed as a set of annularly arranged apertures along the turbine center frame 200.

The exterior and interior ports 206, 210 can provide for exhausting a portion of a mainstream flow 214 passing through the engine 198 in order to minimize flow separation at the corners formed along the beginning and end sections of the diffusion sections 202. A bleed flow 216 can be exhausted at the exterior and interior ports 206, 210 as a flow of bleed air that can be used for other operations requiring a flow of fluid. It should be understood that similar exterior and interior ports 206, 210 can be adopted into any of the other turbine center frame arrangements as described herein, such as implemented in FIG. 5 having three diffusion sections in order to minimize the risk of flow separation in such a turbine center frame.

It should be appreciated an engine including a turbine center frame can include any number of diffusion sections, being two or more, and can be separated by complementary intervening sections. It is further contemplated that the intervening sections need not be provided between two diffusion sections, and can be positioned adjacent the high pressure turbine or the low pressure turbine, for example.

The diffusion sections as described herein provide for diffusing a flow of air through the turbine center frame at an improved rate. The intervening sections provide for stabilizing the airflow diffused through the diffusion sections, maintaining engine efficiency and operating within stall margins. The increased rate of diffusion of the flow of air can minimize the require number of low-pressure turbine sections, reducing engine cost and complexity.

A method of diffusing airflow through a turbine section of a turbine engine can include: directing a flow of air through an upstream diffusion section having an increasing cross-sectional area, directing the flow of air through an intervening section having a constant or a variable cross-sectional area; and directing the flow of air through a downstream diffusion section having an increasing cross-sectional area.

The method can further include where a maximum slope of the upstream diffusion section and the downstream diffusion section is at least 70 degrees. In one example, the slope for the upstream diffusion sections and the downstream diffusion sections are equal, while it is contemplated that they are different. The method can further include that directing the flow of air through the intervening section minimizes flow separation of the flow of air through the turbine center frame.

It should be appreciated that application of the disclosed design is not limited to turbine engines with fan and booster sections, but is applicable to turbojets and turbo engines as well.

This written description uses examples to describe aspects of the disclosure described herein, including the best mode, and also to enable any person skilled in the art to practice aspects of the disclosure, including making and using any devices or systems and performing any incorporated methods. The patentable scope of aspects of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A method of diffusing airflow through a turbine center frame provided in a turbine engine, the method comprising:
- directing a flow of air through an upstream diffusion section;
- stabilizing the flow of air through an intervening section; and
- directing the flow of air through a downstream diffusion section.

2. The method of claim 1 wherein the upstream diffusion section and the downstream diffusion section both include a local maximum slope defining an increasing cross-sectional area, and wherein the local maximum slope is at least 70 degrees.

3. The method of claim 2 wherein stabilizing the flow of air through the at least one intervening section minimizes flow separation of the flow of air through the turbine center frame.

4. The method of claim 1 wherein the turbine center frame turns the flow of air in a tangential direction.

5. The method of claim 1 wherein the upstream diffusion section includes an increasing cross-sectional area and the downstream diffusion section includes an increasing cross-sectional area.

6. A turbine center frame for a turbine engine defining an engine centerline and a flow direction extending from a high pressure turbine to a low pressure turbine, the turbine center frame comprising:
- at least two diffusion sections, upstream and downstream of one another relative to the flow direction; and
- at least one intervening section provided between the at least two diffusion sections.

7. The turbine center frame of claim 6 wherein the upstream diffusion section and the downstream diffusion section includes increasing cross-sectional areas.

8. The turbine center frame of claim 7 wherein the at least one intervening section is provided between the upstream diffusion section and the downstream diffusion section.

9. The turbine center frame of claim 8 wherein the at least one intervening section includes a constant cross-sectional area.

10. The turbine center frame of claim 6 further comprising at least one port provided along the turbine center frame.

11. The turbine center frame of claim 10 wherein the at least one port is provided on a radially outer wall of the turbine center frame toward an aft end of the upstream or downstream diffusion sections.

12. The turbine center frame of claim 10 wherein the at least one port is provided on a radially inner wall of the turbine center frame toward a forward end of the upstream or downstream diffusion sections.

13. The turbine center frame of claim 6 wherein the at least two diffusion sections include a slope that is at least 70 degrees.

14. The turbine center frame of claim 6 further comprising a strut provided within the turbine center frame having a leading edge provided at the upstream diffusion section and a trailing edge provided at the downstream diffusion section.

15. A turbine engine comprising:
- an engine core defining an engine centerline and including a compressor section, a combustion section, and a turbine section including a high pressure turbine and a low pressure turbine in axial flow arrangement defining a mainstream flow path; and a turbine center frame extending from the high pressure turbine to the low pressure turbine including at least two diffusion sections, upstream and downstream of one another relative to a flow direction of the mainstream flow path, the downstream diffusion section spaced further from the engine centerline than the upstream diffusion section;

wherein each of the upstream diffusion section and the downstream diffusion section include increasing cross-sectional areas.

16. The turbine engine of claim 15 further comprising an intervening section provided between the upstream diffusion section and the downstream diffusion section.

17. The turbine engine of claim 16 wherein the intervening section includes a constant cross-sectional area.

18. The turbine engine of claim 15 further comprising at least one port provided along the turbine center frame.

19. The turbine engine of claim 18 wherein the at least one port is provided on a radially outer wall of the turbine center frame toward an aft end of the upstream or downstream diffusion sections.

20. The turbine engine of claim 18 wherein the at least one port is provided on a radially inner wall of the turbine center frame toward a forward end of the upstream or downstream diffusion sections.

21. The turbine engine of claim 15 wherein the turbine center frame further includes a radially inner wall defining a radially inner limit of the mainstream flow path and a radially outer wall defining a radially outer limit of the mainstream flow path.

22. The turbine engine of claim 21 wherein a local maximum of a slope of the radially inner wall or the radially outer wall within the at least two diffusion sections is at least 70 degrees.

23. The turbine engine of claim 21 further comprising a cross-sectional distance defined between the radially inner wall and the radially outer wall orthogonal to the engine centerline.

24. The turbine engine of claim 23 wherein the cross-sectional distance is increasing along at least a portion of the turbine center frame through at least one of the at least two diffusion sections.

25. The turbine engine of claim 15 further comprising a strut provided within the turbine center frame.

26. The turbine engine of claim 25 wherein the strut has a leading edge provided in the upstream diffusion section and a trailing edge provided in the downstream diffusion section.

27. The turbine engine of claim 15 wherein the at least two diffusion sections include three diffusion sections.

28. The turbine engine of claim 15 wherein the turbine center frame begins at an aft end of the high pressure turbine and ends at a forward end of the low pressure turbine.

29. The turbine engine of claim 15 wherein the downstream diffusion section includes a larger cross-sectional area than the upstream diffusion section.

* * * * *